US007874351B2

(12) United States Patent
Hampton et al.

(10) Patent No.: US 7,874,351 B2
(45) Date of Patent: Jan. 25, 2011

(54) DEVICES AND SYSTEMS FOR MEASUREMENT OF POSITION OF DRILLING RELATED EQUIPMENT

(75) Inventors: David Hampton, Elrick (GB); Rob G. Loos, Lafayette, LA (US); Bernt Eriksen, Sola (NO)

(73) Assignee: Baker Hughes Incorporated, Houston, TX (US)

( * ) Notice: Subject to any disclaimer, the term of this patent is extended or adjusted under 35 U.S.C. 154(b) by 178 days.

(21) Appl. No.: 11/933,946

(22) Filed: Nov. 1, 2007

(65) Prior Publication Data

US 2008/0105427 A1 May 8, 2008

Related U.S. Application Data

(60) Provisional application No. 60/856,686, filed on Nov. 3, 2006.

(51) Int. Cl.
*E21B 19/16* (2006.01)

(52) U.S. Cl. ..... 166/77.1; 73/152.45

(58) Field of Classification Search ..... 166/77.1; 175/40; 73/152.45; 702/1, 2, 6, 9, 10, 14; 367/25, 33

See application file for complete search history.

(56) References Cited

U.S. PATENT DOCUMENTS 4,234,942 A * 11/1980 Prause et al. ..... 367/128
4,468,959 A * 9/1984 Roberts ..... 73/152.01
4,635,735 A * 1/1987 Crownover ..... 175/48
4,701,869 A * 10/1987 Callegari et al. ..... 702/158
4,852,665 A * 8/1989 Peltier et al. ..... 175/40
4,926,187 A 5/1990 Sugawara et al.
5,202,680 A * 4/1993 Savage ..... 340/853.1
5,270,717 A 12/1993 Schuermann
5,479,171 A 12/1995 Schuermann
5,594,448 A 1/1997 D'Hont
5,619,207 A 4/1997 D'Hont
5,621,411 A 4/1997 Hagl et al.
7,042,555 B1 5/2006 Lawson
2009/0192715 A1 * 7/2009 Gunsaulis et al. ..... 702/9

FOREIGN PATENT DOCUMENTS

EP 0449710 A2 2/1991
GB 2119833 A 11/1983

* cited by examiner

*Primary Examiner*—Kenneth Thompson
*Assistant Examiner*—Catherine Loikith
(74) *Attorney, Agent, or Firm*—Cantor Colburn LLP

(57) ABSTRACT

A depth measurement system for determining an absolute depth of a drill string uses a position acquisition device to determine a length value for a joint or stand being added to the drill string. The position acquisition device receives a signal from a target object associated with the added joint. The processed signal can be an optical signal, a radio signal, an acoustic signal, or other suitable signal. Using techniques such as time lapse, Doppler effect or phase shift, the depth measurement system determines a position parameter such as distance or position based on the received signal. Thereafter, the processor determines the absolute depth of the drill string by summing a length of each joint making up the drill string and correcting for the position of the newly added joint.

20 Claims, 2 Drawing Sheets

DEVICES AND SYSTEMS FOR MEASUREMENT OF POSITION OF DRILLING RELATED EQUIPMENT

CROSS-REFERENCE TO RELATED APPLICATIONS

This application takes priority from U.S. Provisional Patent application Ser. No. 60/856,686 Nov. 3, 2006.

BACKGROUND OF THE DISCLOSURE

1. Field of the Disclosure

This disclosure relates generally to devices, systems and methods for determining position or location of equipment used in connection with the drilling, completion and/or workover of oilfield wells.

2. Description of the Related Art

Valuable hydrocarbon deposits, such as those containing oil and gas, are often found in subterranean formations located thousands of feet below the surface of the Earth. To recover these hydrocarbon deposits, boreholes or wellbores are drilled by rotating a drill bit attached to a drilling assembly (also referred to herein as a "bottom hole assembly" or "BHA"). Such a drilling assembly is attached to the downhole end of a tubing or drill string made up of jointed rigid pipe or a flexible tubing coiled on a reel ("coiled tubing"). For directional drilling, the drilling assembly can use a steering unit to direct the drill bit along a desired wellbore trajectory.

These drilled wellbores, which can include complex three-dimensional trajectories, intersect various formations of interest. During drilling and in later completion activities, success or failure of effectively producing hydrocarbons from a given formation can hinge on precisely measuring the depth of a given formation and precisely positioning a wellbore tool at a depth corresponding to a given formation. In some instances, a hydrocarbon bearing zone can be only a meter or so in depth. Thus, the positioning of wellbore tools such as a perforating gun or a kickoff for a lateral bore must be positioned well within that one meter range.

Conventional methods of determining wellbore depth are based on the number of joints or stands making up a string in the wellbore. Because each joint has a known length, the depth is determined by tracking the number of joints added to the string. Thus, typically, a processor tracks the number of joints making up a drill string. Often, however, additional joints are continually being added to the string. These additional joints also contribute to the overall length of the drill string, and thus the depth of the drill string. Conventionally, a joint is supported by a traveling block while it is added to the drill string and then the traveling block lowers the drill string into the wellbore. Thus, the vertical distance a traveling block drops indicates how much of a newly added joint has been lowered into the wellbore and how much the depth as increased due to this newly added joint. In one conventional method, the vertical distance traveled by the traveling block is measured using a mechanical device such as a wire or cable coupled to the traveling block. The length of the wire is calibrated to the vertical distance between the traveling block and a reference point such as a rig floor. The change in the vertical distance is measured by a change in wire length as wire during pay out or winding, which then is processed to determine how much of the newly added joint adds to the measured depth of the drill string.

Conventional depth measurement systems, however, may not provide the accuracy needed to position wellbore equipment within a narrow zone of interest, e.g., within a tolerance of a half-meter. The present disclosure is directed to providing more accurate determination of wellbore depth.

SUMMARY OF THE DISCLOSURE

In aspects, the present disclosure provides systems, methods and devices for determining a length of a drill string in a wellbore, i.e., the absolute depth of an element, such as BHA or drill bit, carried by the drill string. For the purpose of this disclosure, the term depth or absolute depth of the drill string means the depth of a selected element of the drill string or the depth of a location in the wellbore. In one embodiment, a processor determines a first length of the drill string by summing a length of each joint making up the drill string. When needed, a position acquisition device receives a signal from a target object associated with a joint being added to the drill string. The received signal is processed to determine a second length that the newly added joint adds to the drill string. The processor determines the absolute depth of the drill string by adding the first length to the second length. The processed signal can be an optical signal, a radio signal, an acoustic signal, or other suitable signal.

In embodiments using an optical signal, an exemplary position acquisition device includes a laser positioned at a selected location on a rig. The laser directs an optical signal, the laser beam, to the target object. A receiver positioned on the rig receives the optical signal reflected from the target object and a processor processes the reflected signal to determine a distance to the target object. In embodiments using radio signals, an exemplary position acquisition device includes one or more transponders positioned at one or more target objects that transmits a radio signal. A receiver on the rig receives the signal from the transponder and a processor processes the received signal to determine a distance to the target object.

It should be understood that examples of certain features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
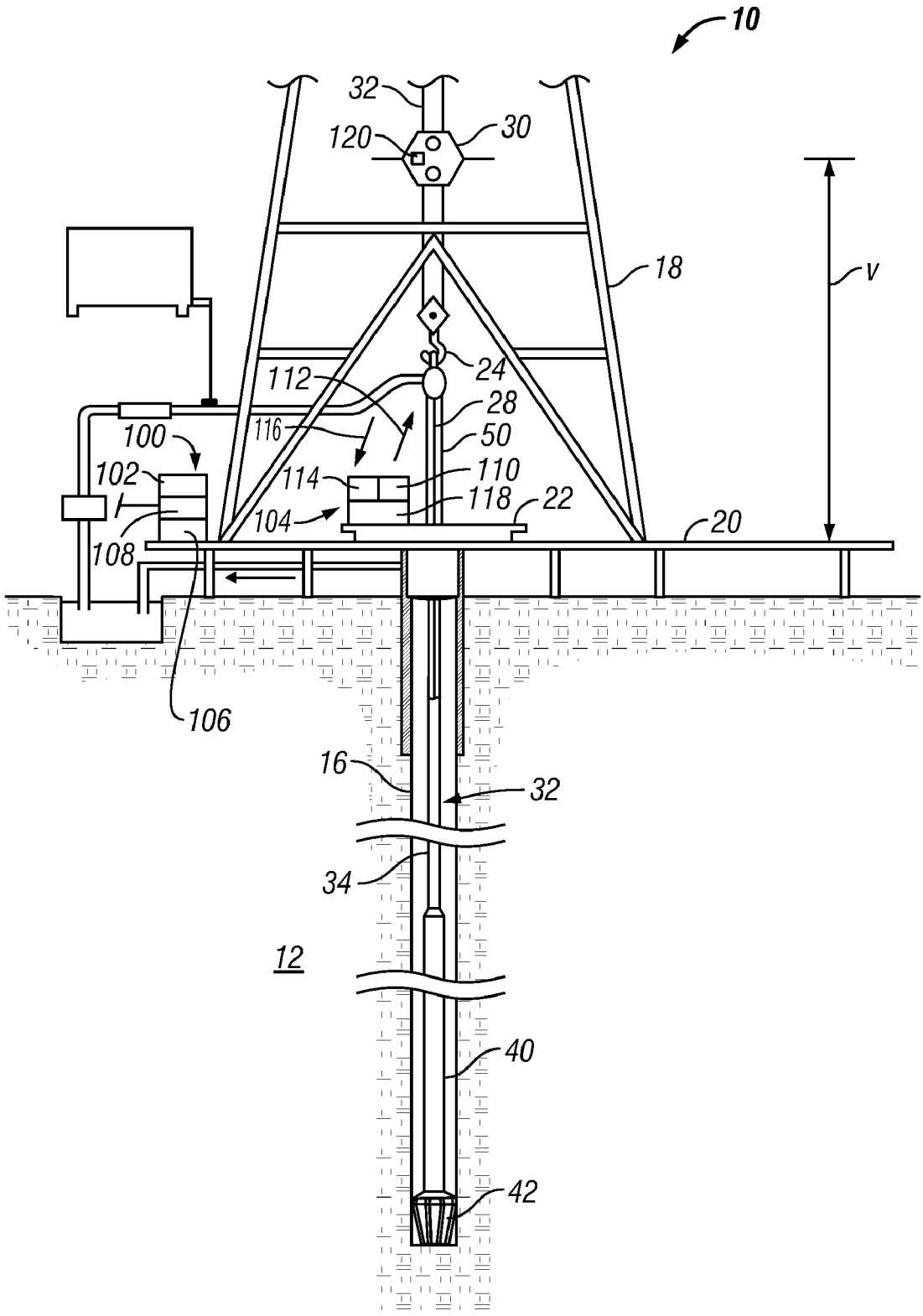
FIG. 1 shows a schematic diagram of a drilling system with a depth measurement system according to one embodiment of the present disclosure.

The present disclosure, in one aspect relates to devices and methods for providing absolute depth information for a tubular string such as a drill string conveyed into a wellbore in a subterranean formation. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown a drill rig 10 positioned over a formation of interest 12. As shown, a wellbore 16 is being drilled into the earth under control of surface equipment including a derrick 18, a derrick or drill floor 20, a hook 24, a kelly joint 28, and a traveling block 30. Other equipment known in the art such as draw works are not shown. The traveling block 30 and a drill string 32 connect the derrick 18 with a load of pipe to be lowered into or withdrawn from the borehole 16. A rotary table 22 rotates a drill string 32 that includes drill pipe 34 secured to the lower end of the kelly joint 28. Alternatively, a top drive or other suitable device may be used to rotate the drill string 32. The drill string 32 is formed of jointed tubulars and can include a bottomhole assembly (BHA) 40 having a drill bit 42 at a distal end. The BHA also may include a variety of sensors and tools, including, but not limited to, tools for drilling directional wellbores, directional sensors, temperature and pressure sensors and formation evaluation measurement-while-drilling tools, such as resistivity, nuclear, and nuclear magnetic tools. While a drill string of jointed tubulars is shown, the string can also include casing joints, liner joints or other equipment used in well completion activities. Additionally, while a land rig is shown, it should be understood that the teachings of the present disclosure can be readily applied to offshore drilling such as that performed on facilities such as drill ships or offshore platforms. Further, it will be understood by those skilled in the art that different systems such as top drive systems may utilize equipment different from that shown in FIG. 1.

A depth measurement system 100 is provided to determine the "measured" or "absolute" depth of the BHA 40. As used herein, the term "absolute" or "measured" depth is the length of the wellbore as opposed to true vertical depth (TVD), which is vertical distance from the surface to a location in the wellbore. In one embodiment, the depth measurement system 100 includes a controller 102 and a position acquisition device 104. The controller 102 includes one or more processors 106 programmed with suitable instructions for tracking the number of joints making up the string 32 in the wellbore 16 and the length of each joint. Thus, the controller 102 can make an initial determination of the depth of the BHA 40 by summing the lengths of all the joints in the wellbore 16. The controller 102 can include a communication device 108 for communicating with external devices. For instance, the controller 102 can receive signals that indicate that a joint has been added to the string 32.

The position acquisition device 104 provides additional information for determining the length that a joint to be added to the drill string 32 may contribute to the overall length of the drill string. As used herein, the term "joint" means a single pipe whereas a "stand" means two or more made-up joints. A representative joint or stand has been labeled with the numeral 50. With respect to the present teachings, however, there is no particular relevance as to whether a joint or a stand is being added to the string. For clarity, the term "tubular" or "tubular element" may be used to refer to such components. In many instances, the amount that the joint 50 adds to the absolute depth is considered to be the vertical distance between the location such as the traveling block 30 and an arbitrary reference point such as the rig floor 20. For convenience, this vertical distance is labeled with the reference sign V. Thus, if the measured vertical distance V changes from ten meters to five meters, then the joint 50 is presumed to have added five meters to the measured depth.

In one embodiment, the position acquisition device 104 determines one or more position parameters for the joint 50 to be added to the drill string 32. The acquisition device includes a signal transmitter 110 that directs a signal 112 having one or more known characteristics such as frequency or amplitude to a selected location on the equipment that has a relatively fixed relationship with the newly added joint. By fixed relationship, it is meant that a change in position of the joint to be added can be determined from a measured change in position of the selected location. Exemplary equipment include, but are not limited to the kelly joint 28, hook 24, the traveling block 30, a top drive (not shown) or a compensator (not shown). Hereafter, for brevity, such an object will be referred to as a "target object." The position acquisition device 104 also includes a signal receiver 114 that receives the signal 116 after it has reflected from the target object. A processor 118 in the position acquisition device 104 processes the reflected signal 116 to determine the distance to the target object. This processing can include determining a change in one or more characteristics in the reflected signal 116 or the time between signal transmission and reception. In another arrangement, "raw" or partially processed signal data can be transmitted to the depth measurement system 100 for processing. In either case, the data is transmitted to the depth measurement system 100 via a suitable communication device (not shown).

In some applications, the target object can have a configuration that is suited for signal reflection. In other instances, a reflector 120 can be mounted on the target object to present a reflective surface that can enhance the quality or strength of the reflected signal. Additionally, while the signal transmitter 110 is shown as on the rig floor 20 and pointed up to the target object, the signal transmitter 110 can also be positioned at an elevated location on the rig 10 and point down. For example, the transmitter can be positioned on a crown block (not shown) or other similar location on the derrick 18.

In one configuration, the position acquisition device 104 uses optical signals to determine the distance to a reflective object. For instance, the signal transmitter 110 can include a laser that emits a beam of light energy. The acquisition device 104 can utilize the time of flight principle by sending a laser pulse in a narrow beam towards the target object and measure the time taken by the pulse to be reflected off the target and return to the signal receiver 114. In other embodiments, the signal transmitter 110 can emit radio signals and process reflected signals according to known radar techniques. In yet other embodiments, acoustic energy such as a sound wave can be used to determine distance.

Figure 2:
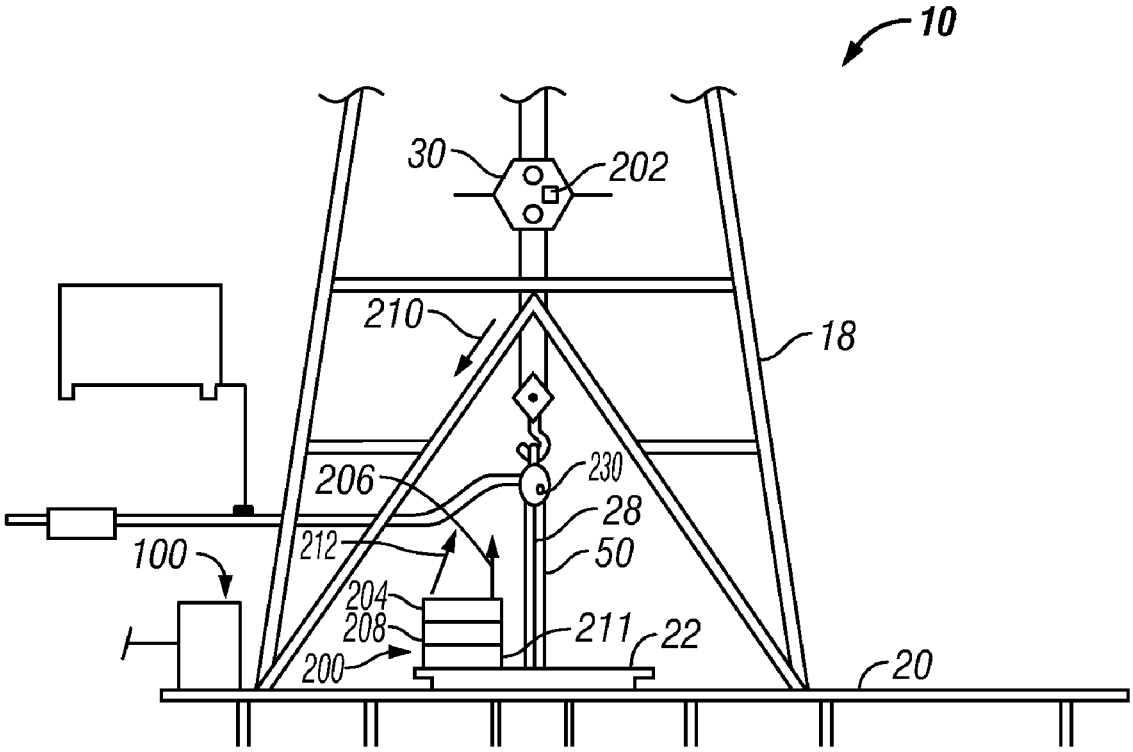
FIG. 2 shows a schematic view of another depth measurement system according to one embodiment of the present disclosure.

Referring now to FIG. 2, there is shown another embodiment of a position acquisition device 200 that uses radio waves to determine a position of a target object relative to a selected reference point. The acquisition device 200 uses radio frequency identification (RFID) principles and includes a tag or transponder 202, an interrogator or transceiver 204, an antennae 206, and a processor 208 programmed with appropriate software. The transponder 202 is positioned on a target object that moves with the newly-added joint 50; e.g., the traveling block 30. The transponder 202 transmits a radio signal 210 that is received by the transceiver 204 via the antennae 206. The signal 210 can be in response to an interrogating signal 212 transmitted by the transmitter 204. The received signal 210 is processed by the processor 208 to determine the distance to the target object. The processor 208 can use known techniques such as time elapse, Doppler effect or phase shift to process the received signals. The received signal 210 can itself provide the necessary information or the processor 208 can determine position information based on a plurality of received signals 210. Positioning using RFID is discussed in U.S. Pat. No. 5,621,411, which is hereby incorporated by reference for all purposes. Once the distance has been determined, a signal representative of the determined distance is transmitted via a communication device 211 to the depth measurement system 100. The signal can indicate a value for a vertical distance or a value for a distance that the depth measurement system 100 can further process to determine the vertical distance.

In some embodiments, two or more transponders can be utilized. For instance, a second transponder 230 can be positioned on the kelly joint 28. To facilitate identification, each transponder 202, 230 can use a unique signal identifier, but this need not necessarily be the case. In any event, the position acquisition system 200 can use the signals from the multiple transponders 202, 230 to calculate distance. It should be understood that target objects such as the traveling block 30 and the kelly joint 28 are merely illustrative and that transponders can be distributed as needed throughout the rig 10.

The transponder 202 can be passive or active. In one variant of the passive transponder 202, an incoming radio frequency signal or interrogating signal 212 generates sufficient electrical current induced in an antenna (not shown) provided in the transponder 202 for circuitry such as a CMOS integrated circuit in the transponder 202 to power up and transmit the responsive signal 210. The responsive signal 210 can include a preprogrammed value such as an ID number as well as collected data. In one variant of the active transponder 202, an internal power source supplies power for the onboard circuitry and can also transmit the signal 210 having pre-programmed data or collected data. The active transponder 202 can transmit such signals 210 in response to a signal or transmit the signals 210 without a prompt at a specified time, event or interval.

In still another variant not shown, the acquisition device can be positioned on the target object and programmed to transmit a measured distance. The acquisition device can include a signal transmitter, a receiver, a processor and a communication device. For example, the transmitter can transmit a signal that reflects from a specified location on a rig floor or derrick and is received by the receiver. The processor can process the reflected signal and transmit a distance or position measurement via the communication device. Alternatively, the received signal can be transmitted via a communication device to another device, such as the controller 102 (FIGS. 1 and 2), for processing.

Referring now to FIGS. 1 and 2, the present teachings can be used in connection with determining the absolute depth of a drill string 32 during drilling of a wellbore 16 or subsequent trips into the wellbore 16. In one mode of deployment of the depth measurement system 100, the processor 106 keeps track of the number of joints or stands making up the drill string 32. The summation of the lengths of these joints and stands provides a preliminary absolute depth of the drill string 32. This value can be a cumulative value, which is updated with every joint or stand added to the string 32, or a continuously re-calculated value by using the total number of joints and the known length of each joint. This preliminary absolute depth is stored in a suitable memory device (not shown).

Periodically, a new joint or stand 50 is added to the drill string 32. During such events, the position indication device 104 receives a signal 116 or 210 from the target object. This signal can be a signal transmitted from the target object or reflected from the target object. In either instance, the signal is processed using preprogrammed instructions to determine the distance to the target object. It should be appreciated that the processed signal provides a direct measurement of the distance separating the target object and the receiver. In some instances, the determined distance is a purely vertical distance V. In other instances, the determined distance will have a vertical component and a horizontal component. In those cases, the processed signal will be analyzed using angular measurements to determine the vertical component V. The processor next correlates this determined vertical distance V to the amount the newly-added joint adds to the preliminary calculated absolute depth. In many instances, the amount that a newly-added joint adds to the preliminary calculated absolute depth is the same as the determined vertical distance V, but this may not always be the case. In any event, this additional mount, or correction, is then added to the preliminary calculated absolute depth to determine the final absolute depth of the drill string 32. A display (not shown) can be used to present the final absolute depth and this value can be also recorded in a suitable memory module.

It should be appreciated that the teachings of the present disclosure can be utilized in numerous versions beyond the non-limiting examples given above. For instance, while the target object has been described as surface equipment connected to a joint or stand, in some embodiments, the joint or stand itself may be the "target object." Furthermore, while distance or vertical distance has been discussed above, it should be understood that embodiments of position acquisition devices in accordance with the present disclosure can also determine parameters such a motion, velocity, acceleration, vibration, and coordinates for the target object and/or the joint or stand being added to a tubular string.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A method for estimating a length of a drill string in a wellbore, comprising:

using a processor to:

determine a first length by summing a length of each tubular making up the drill string;

process a signal received at a receiver from a target device related to a tubular being added to the drill string, wherein the received signal represents a measured direct distance from the target to the receiver to determine a second length; and determine the length of the drill string by adding the first length to the second length.

2. The method of claim 1 wherein the signal is one of (i) an optical signal, (ii) a radio signal, (iii) an acoustic signal.

3. The method of claim 1 wherein the signal has been reflected from the target device.

4. The method of claim 1 wherein the signal has been transmitted from the target device.

5. The method of claim 1 further comprising emitting the signal from a laser.

6. The method of claim 5 further comprising positioning the laser at one of (i) above the target device, and (ii) below the target device.

7. The method of claim 1 further comprising transmitting an interrogating signal, the signal received from the target device-being in response to the interrogating signal.

8. The method of claim 1 wherein the target device comprises a transponder on the target device, the transponder emitting the signal.

9. The method of claim 1 wherein using the processor to process the signal includes directly determining a vertical distance between the target device coupled to a traveling block and the receiver coupled to the rig floor.

10. The method of claim 1 further forming a relatively fixed relationship between the target device and the newly added tubular.

11. The method of claim 1, wherein using the processor to: determine the first length, process the signal and determine the length is configured to occur during a drilling operation to estimate the length of the drill string.

12. The method of claim 1, wherein using the processor to process the signal comprises using a single measurement to determine the distance from the target device to the receiver proximate the rig floor.

13. A system for determining a position of a target device associated with a tubular being added to a drill string disposed in a wellbore, comprising:

a rig configured to convey the drill string into the wellbore;

a laser positioned at a selected location on the rig, the laser directing an optical signal to the target device;

a receiver receiving the optical signal reflected from the target device and a processor configured to determine a first length by summing a length of each tubular making up the drill string; process the reflected signal received directly from the target device to determine a second length, wherein the reflected signal represents a measurement; and determine the length of the drill string by adding the first length to the second length.

14. The system of claim 13 wherein the laser is positioned at one of (i) above the target device, and (ii) below the target device.

15. The system of claim 13 wherein the processor is configured to determine a vertical distance between the target device coupled to a traveling block and a reference point proximate to the receiver coupled to the rig floor.

16. The system of claim 13 wherein the processor includes a memory programmed with a length of at least one tubular in the drill string.

17. An apparatus for determining a position of a target device associated with a tubular being added to a drill string disposed in a wellbore, comprising:

a transponder positioned at the target device, the transponder transmitting a signal;

a receiver receiving the signal directly from the transponder; and a processor configured to:

determine a first length by summing a length of each tubular making up the drill string;

determine a second length by processing the received signal from the target device associated with the tubular being added to the drill string wherein the received signal includes a direct measurement; and to determine the length of the drill string by adding the first length to the second length.

18. The apparatus of claim 17 further comprising a transmitter transmitting an interrogating signal to the transponder, the signal being responsive to the interrogating signal.

19. The apparatus of claim 17 wherein the processor determines a vertical distance between the target device and a reference point proximate to the receiver coupled to the rig floor.

20. The apparatus of claim 17 wherein the signal is one of (i) an optical signal, (ii) a radio signal, (iii) an acoustic signal.

* * * * *